US006099058A

United States Patent [19]

Asai et al.

[11] Patent Number: 6,099,058

[45] Date of Patent: Aug. 8, 2000

[54] GRIPPING DEVICE

[75] Inventors: Akira Asai; Takashi Asai; Yoshiro Asai, all of Osaka, Japan

[73] Assignee: Kabushiki Kaisha Asai Tekkosho, Moriguchi, Japan

[21] Appl. No.: 09/185,728

[22] Filed: Nov. 4, 1998

[30] Foreign Application Priority Data

| | | | |
|---|---|---|---|
| Nov. 6, 1997 | [JP] | Japan | 9-304517 |
| Mar. 3, 1998 | [JP] | Japan | 10-050980 |
| Oct. 5, 1998 | [JP] | Japan | 10-282213 |

[51] Int. Cl.[7] ..... B66C 1/42

[52] U.S. Cl. ..... 294/103.1; 294/119.1; 294/902; 269/237; 269/272; 269/287; 269/902

[58] Field of Search ..... 294/103.1, 119.1, 294/902; 269/95, 99, 139, 172, 237, 272, 287, 902; 901/45

[56] References Cited

U.S. PATENT DOCUMENTS

| | | | |
|---|---|---|---|
| 2,484,339 | 10/1949 | Fuhr | 269/139 |
| 2,615,682 | 10/1952 | Stone | 81/57.21 |
| 3,829,077 | 8/1974 | Strybel | 269/107 |
| 4,146,214 | 3/1979 | Gamble | 269/272 |
| 4,223,937 | 9/1980 | Winston | 294/103.1 |
| 4,819,978 | 4/1989 | Scheinman et al. | 294/119.1 |
| 4,824,085 | 4/1989 | Buchler | 269/139 |

*Primary Examiner*—Dean J. Kramer
*Attorney, Agent, or Firm*—Wenderoth, Lind & Ponack, L.L.P.

[57] ABSTRACT

A gripping device which can grip small articles of different shapes without the need to work its chucking surfaces or to use blocks and liners in combination, and which can position articles in parallel to or perpendicular to a reference surface with a single gripping device. A fixed yoke, a movable yoke and an anvil-side yoke are connected to two columns so that all the yokes can pivot relative to the columns and the movable yoke can further slide relative to the columns to form a parallel crank mechanism. The fixed yoke is provided with a threaded shaft for moving the movable yoke. V grooves are formed in opposed surfaces of the movable yoke and the anvil-side yoke. A plurality of cuts are formed at the portion where the V-grooves are formed in parallel to the columns. The cuts define plate members having V-grooved gripping portions meshing with each other.

13 Claims, 8 Drawing Sheets

GRIPPING DEVICE

BACKGROUND OF THE INVENTION

This invention relates to a gripping or chucking device for accurately, reliably and quickly gripping or chucking small workpieces having irregular shapes in order to work them.

To grip or chuck workpieces, especially small ones, having triangular, L-shaped, semicircular, trapezoidal or other sectional shapes, chucking surfaces had to be worked so as to be complementary to the contour of the workpiece, or V blocks or liners were used in combination.

With such conventional gripping devices for gripping small workpieces having various shapes, flexibility and work efficiency were poor. It was also extremely difficult to position a workpiece in parallel to or perpendicular to an X-Y table of a machine tool.

An object of this invention is to provide a gripping device which can reliably grip small articles having different shapes with a single gripping device without the need to work its chucking surfaces to a special shape that is complementary to the contour of each article or without the need to use V blocks or liners in combination, and which can position articles in parallel to or perpendicular to an X-Y table of a machine tool.

SUMMARY OF THE INVENTION

According to this invention, there is provided a gripping device for gripping small articles having different shapes, comprising a fixed yoke, a movable yoke, an anvil-side yoke and two columns. The two columns extend from the movable yoke to at least one of the fixed yoke and the anvil-side yoke and are pivotably coupled thereto by pins rotatably provided at both ends thereof to form a parallel crank mechanism. The fixed yoke has a means for pushing and pulling said movable yoke. The movable yoke and the anvil-side yoke have opposed portions that are formed with V grooves perpendicularly to the yokes. Also, a plurality of cuts are formed so as to be parallel to the yokes at the portion of the grooves so that plate-shaped V-grooved gripping portions mesh with each other.

Other features and objects of the present invention will become apparent from the following description made with reference to the accompanying drawings, in which:

BRIEF DESCRIPTION OF THE INVENTION

DETAILED DESCRIPTION OF THE PREFERRED EMBODIMENT

First Embodiment

Figure 1:
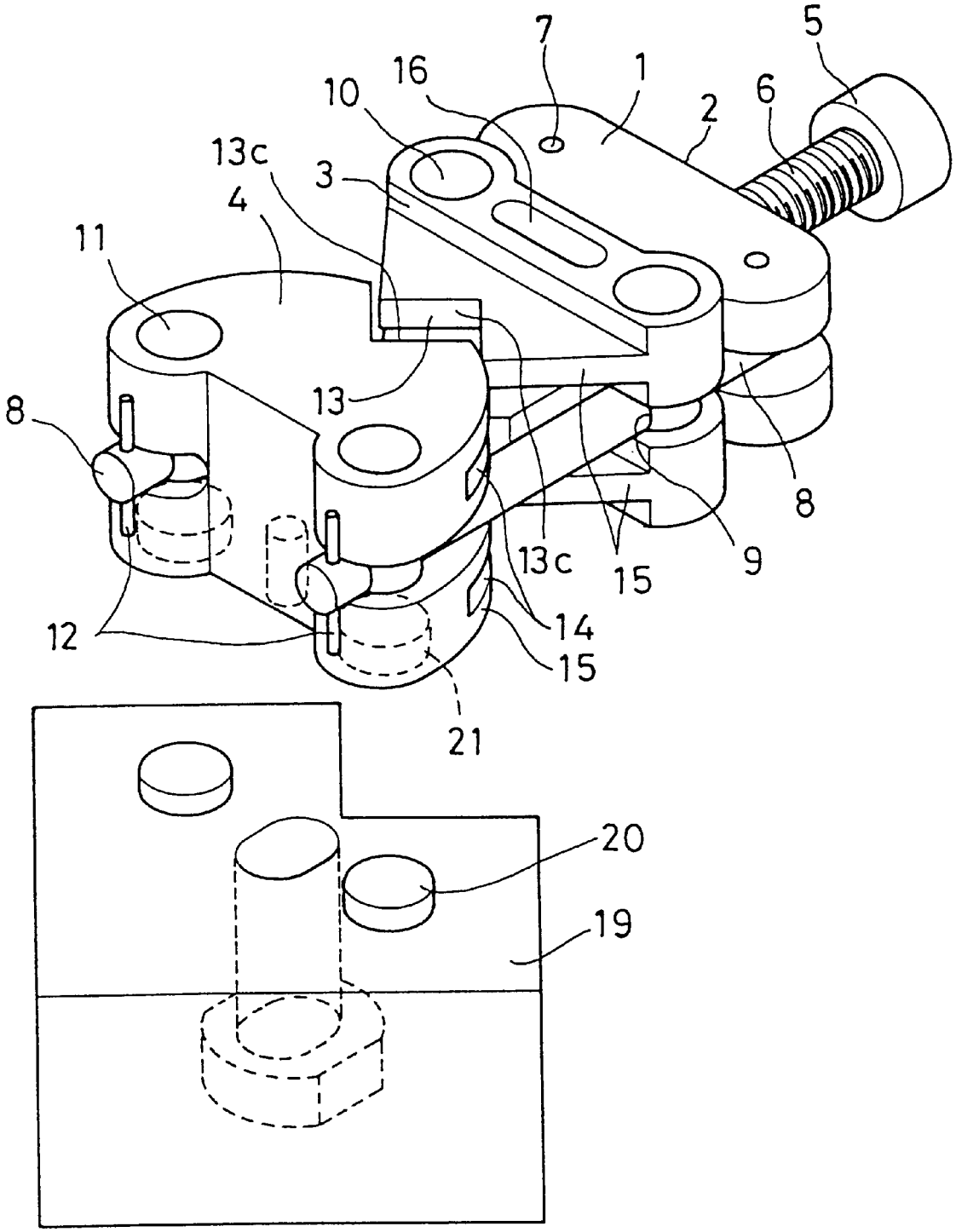
FIG. 1 is a perspective view of a first embodiment constructed in accordance with to this invention.

The first embodiment of this invention is now described with reference to FIGS. 1 and 2. A threaded hole 2 is formed in the center of a fixed yoke 1. A threaded shaft 6 (having a knob 5 for turning the shaft) threads into the threaded hole 2 to move a movable yoke 3 toward and away from an anvil-side yoke 4. A column 8 is pivotally mounted to each end of the fixed yoke 1 by a pin 7.

Pins 10, 11 extend through the yokes 3 and 4, respectively, at their opposed ends. The columns 8 are slidably inserted through holes 9 in the pins 10, 11 formed perpendicularly to their axes. The movable yoke 3 for pressing an article to be gripped and the anvil-side yoke 4 for supporting the article are pivotally coupled together by the columns 8 and the pins 10 and 11. The distance between the pins 7 of the fixed yoke 1, the distance between the pins 10 of the movable yoke 3, and the distance between the pins 11 of the anvil-side yoke 4 are equal to each other. Split pins 12 are inserted in the free ends of the columns 8 to prevent the anvil-side yoke 4 from slipping out of the columns 8.

V grooves 13 for gripping the article to be gripped are formed in the movable yoke 3 and the anvil-side yoke 4 at their portions facing each other. At the portions where the V grooves 13 are formed, a plurality of cuts 14 (FIG. 1) are formed in the movable yoke 3 and the anvil-side yoke 4 so as to be parallel to each other. The cuts 14 define a plurality of plate portions 15 having V-grooved gripping portions 13*c*. The plate portions 15 of the movable yoke 3 are adapted to mesh with those of the anvil-side yoke 4.

Near the center of the movable yoke 3, elongate holes 16 and 17 are formed so that they extend parallel to and perpendicularly to the axes of the pins 10 at both ends of the yoke 3, respectively. The tip of the threaded shaft 6 engages in the elongate hole 17 and is coupled to the yoke 3 by a snap washer 18 so as to be pivotable within the range permitted by the elongate holes 16, 17.

Figure 2A:
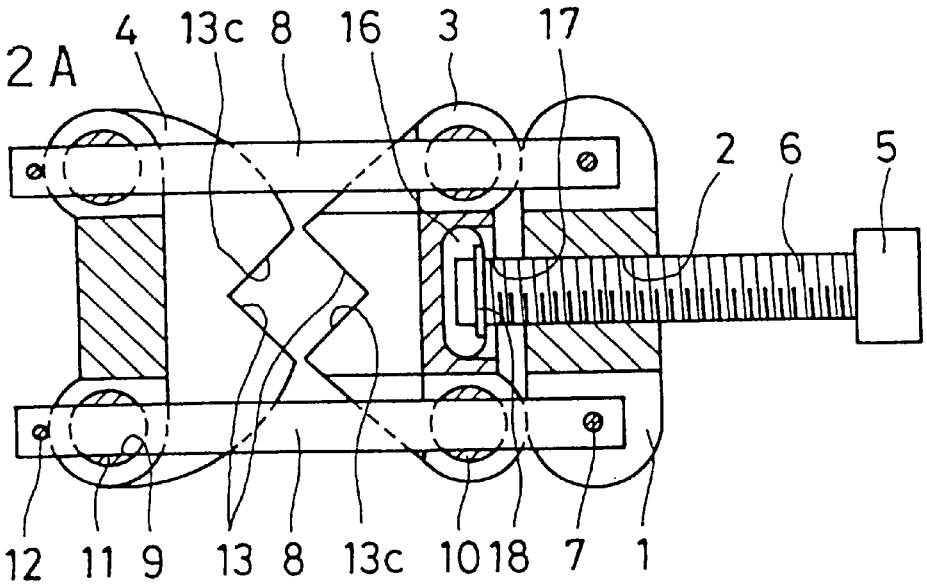
FIG. 2A shows a state in which the embodiment shown in FIG. 1 is used to grip a square or circular article.
Figure 2B:
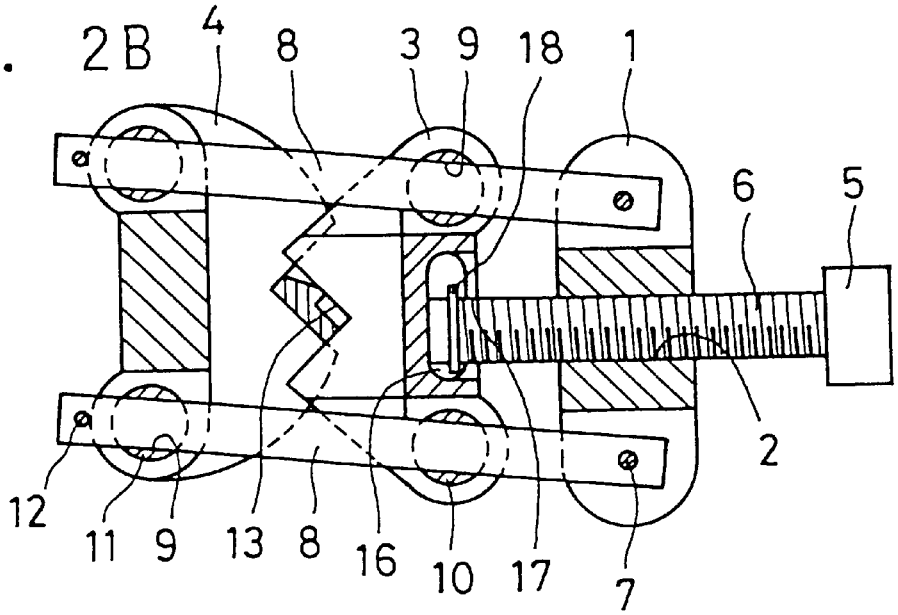
FIG. 2B shows a state in which an article having a rectangular or L-shaped section is gripped.

Now in operation, if the article to be gripped has a square, circular, hexagonal or triangular section, with the article supported on the V-grooved gripping portions 13*c* of the anvil-side yoke 4, the movable yoke 3 is moved toward the anvil-side yoke 4 by turning the threaded shaft 6 to grip the article between two yokes as shown in FIG. 2A. If the article to be gripped has a rectangular or L-shaped section, the entire device moves parallelogrammatically so that the V-grooved gripping portions 13*c* define a rectangle as shown in FIG. 2B. The article is thus firmly gripped with its reference surfaces along the surfaces of the V-grooved gripping portions.

In FIG. 1, there is shown a block 19 for fixing the gripping device of this embodiment on a machine tool or the like. This block 19 has a substantially L-shaped section formed by cutting a hexahedral block at its one corner in a V shape as shown at 30 (on FIG. 3A), and has knocks 20 embedded in its top surface. By inserting the knocks 20 into knock-receiving holes 21 formed in the back of the anvil-side yoke 4, the gripping device is fixed in position with the bisector of the V-grooved gripping portions aligned with the bisector of the V-shaped cutout in the block 19. By fixing the block 19 to an X-Y table in this state, the article to be gripped is automatically positioned with its reference surface parallel to the reference surface of the X-Y table.

When the block 19 is mounted on the back of the anvil-side yoke 14, the bottom of the V-grooved gripping portion is adapted to protrude from the cut surface. This makes it easier to grip a long article and prevents damage to the block and the cutting tool while a through hole is formed in the workpiece.

Second Embodiment

Figure 3A:
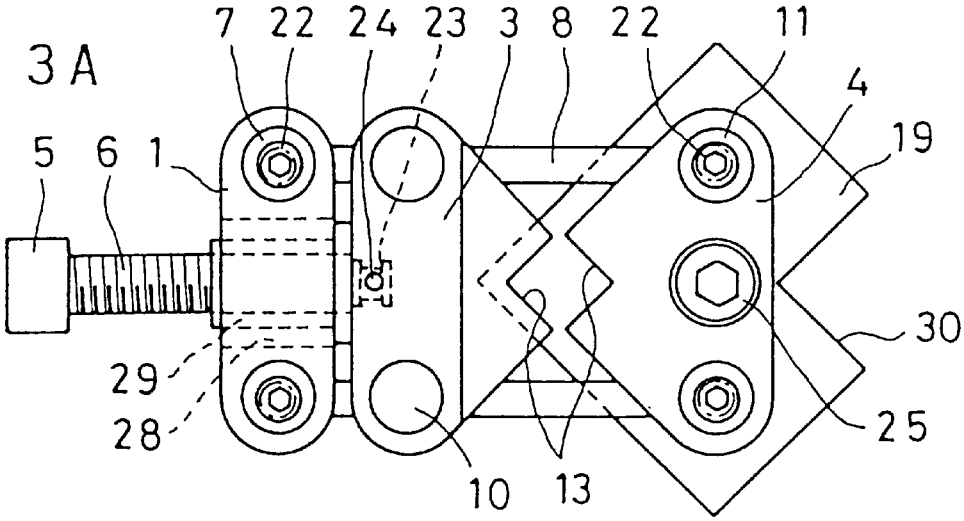
FIG. 3A is a plan view of a second embodiment constructed in accordance with this invention.
Figure 3B:
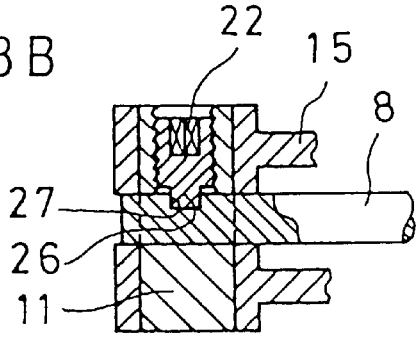
FIG. 3B shows a coupling structure between a column and a pin.

Now referring to FIGS. 3A–3B, the second embodiment is described. In its basic structure, this embodiment is substantially the same as the first embodiment. Thus, only what differs from the first embodiment is described.

In the first embodiment, the threaded shaft 6 is pivotally coupled to the movable yoke 3 by the elongate holes 16, 17 formed in the movable yoke 3. In the second embodiment, the threaded shaft 6 is coupled to the movable yoke 3 so as to be rotatable but not pivotable relative to the yoke 3. The threaded shaft 6 is rotatably coupled to the yoke 3 by a pin 24 inserted in a cutout 23 formed at its tip.

The fixed yoke 1 is formed with an elongate hole 28 in which is slidably fitted a female threaded bushing 29 in which the threaded shaft 6 engages. When the entire gripping device moves parallelogrammatically, the bushing 29 slides in the elongate hole 28.

To couple the anvil-side yoke 4 and the columns 8, the pins 11 mounted in the anvil-side yoke have holes 9 (see FIG. 2) extending perpendicularly to the pin axes. The columns 8 extend through the holes 9. A hexagonal screw 22 is screwed into the center of each pin 11 so that a protrusion at its tip engages in a hole 27 formed in each column 8 (FIG. 3B), thus preventing separation. The fixed yoke 1 and the columns 8 are also coupled together in a similar manner.

The gripping device of this embodiment is mounted to the block 19 and positioned by the knocks 20 as in the first embodiment (see FIG. 1). A hexagonal screw 25 extends through a hole formed in the center of the anvil-side yoke 4 and into an internally threaded hole formed in the block 19.

By turning the block 19 by 180°, the cut portion 30 is positioned under the V-grooved portion 13*c*, so that a long article can be gripped easily. This prevents damage to the block and the cutting tool when forming a through hole in the workkpiece.

Third Embodiment

Figure 4:
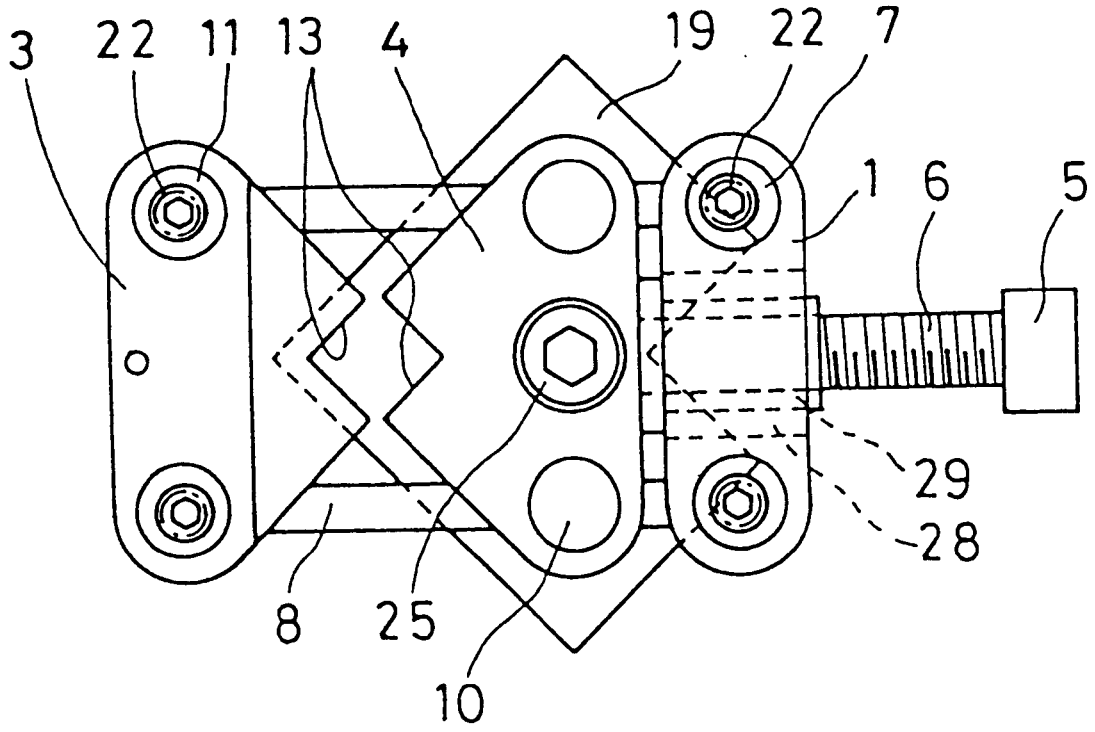
FIG. 4 is a plan view of a third embodiment constructed in accordance with this invention.

FIG. 4 is the third embodiment, which is basically the same as the second embodiment except that the positions of the movable yoke 3 and the anvil-side yoke 4 are reversed. Thus in this embodiment, the anvil-side yoke 4 is movable relative to the columns 8.

In this embodiment, the anvil-side yoke 4 is at the center of the entire gripping device and is mounted to the block 19. This ensures mounting with good balance.

Fourth Embodiment

Figure 5A:
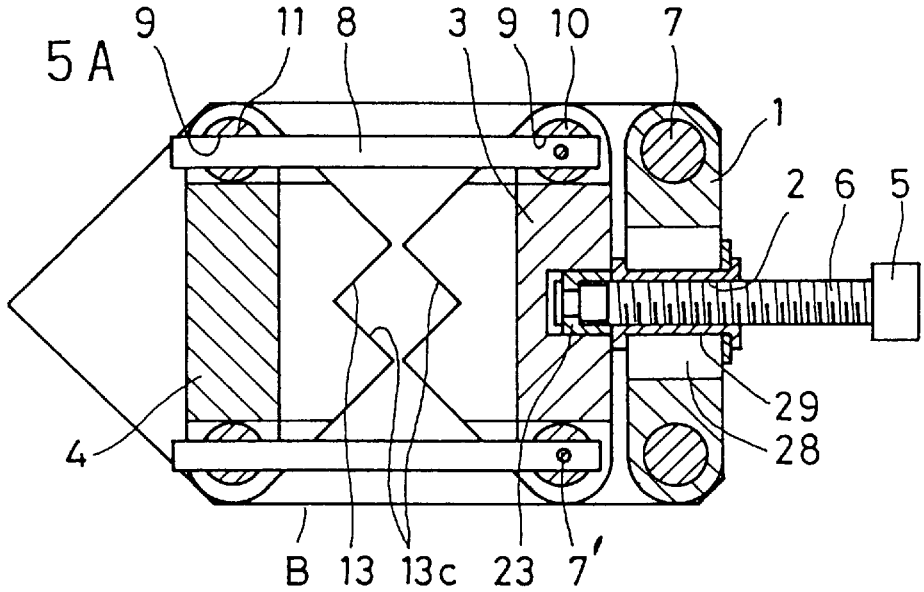
FIG. 5A is a plan view of a fourth embodiment constructed in accordance with this invention.
Figure 5B:
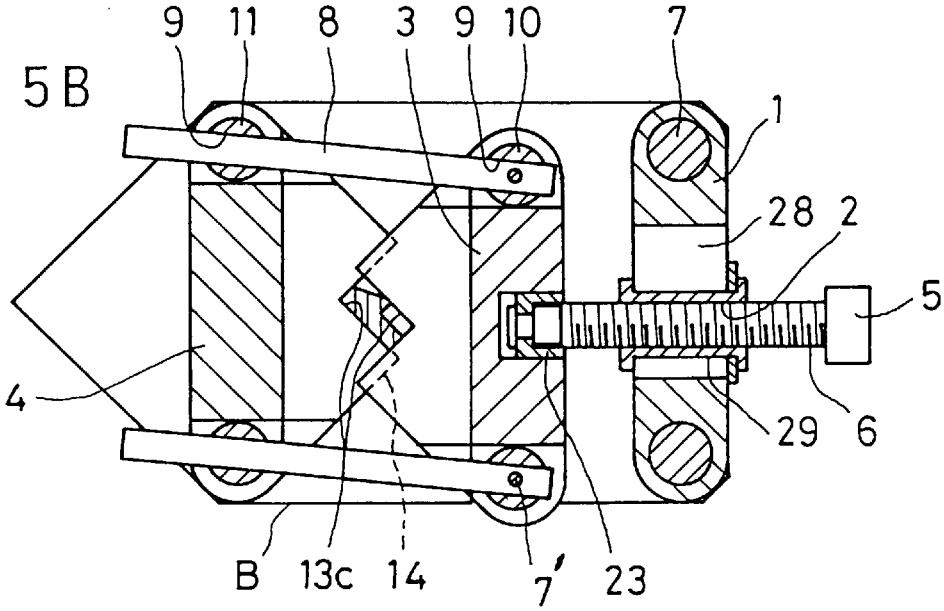
FIG. 5B is a plan view of the fourth embodiment showing a state in which an article having an irregular section is gripped.

FIGS. 5A—5B show the fourth embodiment, which is the same as the previous embodiments in that small articles of various shapes are gripped by meshing plate-shaped V-grooved gripping portions 13*c* defined by a plurality of cuts 14. Thus, only the difference is described below.

An anvil-side yoke 4 and a fixed yoke 1 are fixed to a base B. An elongate hole 28 is formed in the center of the fixed yoke 1. A bushing 29 having female threads 2 slidably fits in the elongate hole 28.

A threaded shaft 6 having a knob 5 at one end meshes with the female threads 2 of the bushing 29. A cut 23 is formed at its tip. It is received in the center of the movable yoke 3 and coupled thereto by an unillustrated pin so as to be pivotable but is prevented from coming off.

Columns 8' extending from the movable yoke 3 to the anvil-side yoke 4' are pivotably coupled to the yokes 3 and 4 through pins 10 and 11, respectively, rotatably provided on both ends of the yokes 3 and 4. The columns 8 are secured to the pins 10 of the movable yoke 3 by pins 7' so as not to be slidable in the holes 9 of the pins 10, but are slidable in the holes 9 formed in the pins 11 of the anvil-side yoke 4.

Thus, the movable yoke 3, the anvil-side yoke 4 and the columns 8 connecting them together constitute a parallel crank mechanism through the pins 10 and 11. By turning the threaded shaft 6, the V-grooved gripping portions 13*c* of the yokes 3 and 4 are moved toward and away from each other. Small articles having irregular shapes can be gripped efficiently and reliably by the parallelogrammatic movement of the device as shown in FIG. 5B.

Fifth Embodiment

Figure 6A:
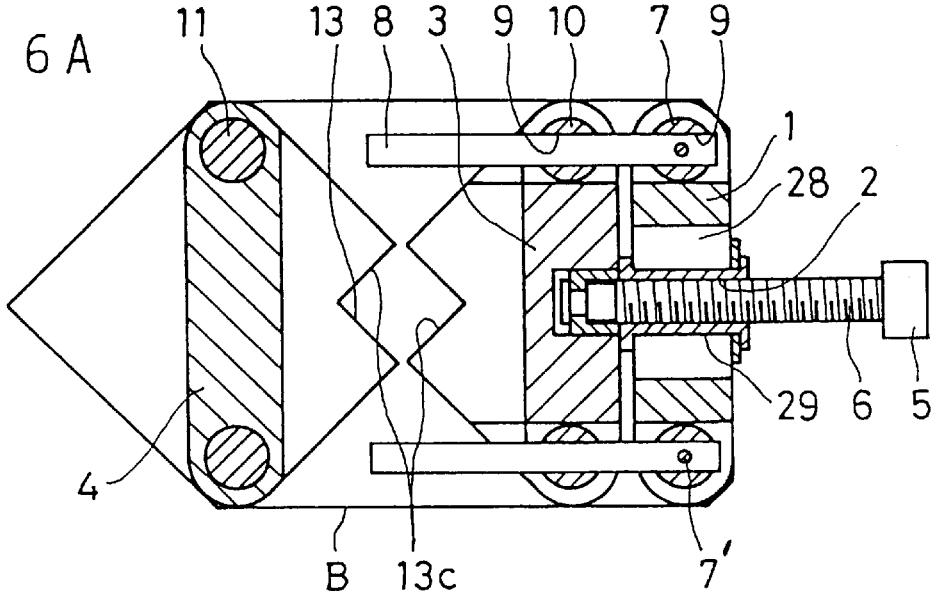
FIGS. 6A and 6B are similar views of a fifth embodiment constructed in accordance with this invention.
Figure 6B:
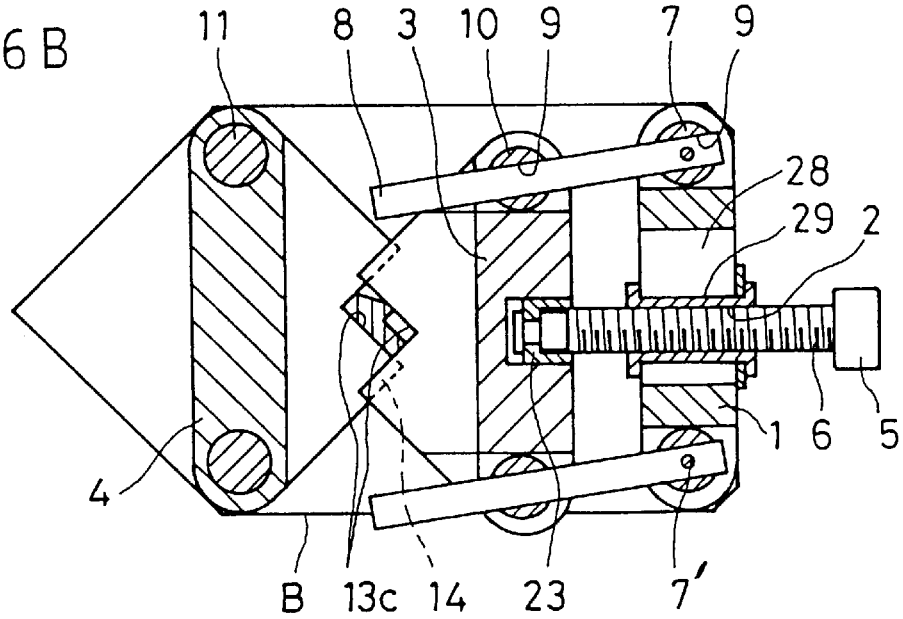

FIGS. 6A–6B show the fifth embodiment, which is structurally the same as the fourth embodiment except that columns 8 forming a parallel crank mechanism extend from the fixed yoke 1 to the movable yoke 3 and are pivotably coupled to the yokes 1 and 3 by pins 7 and 10, respectively, rotatably provided on both ends of the yokes 1 and 3. To grip small articles having irregular shapes, the fixed yoke 1, movable yoke 3 and columns 8 are parallelogrammatically moved so that the movable yoke 3 is moved toward the anvil side yoke 4 along the columns 8 as shown in FIG. 6B. The article can thus be gripped efficiently and reliably.

Figure 7A:
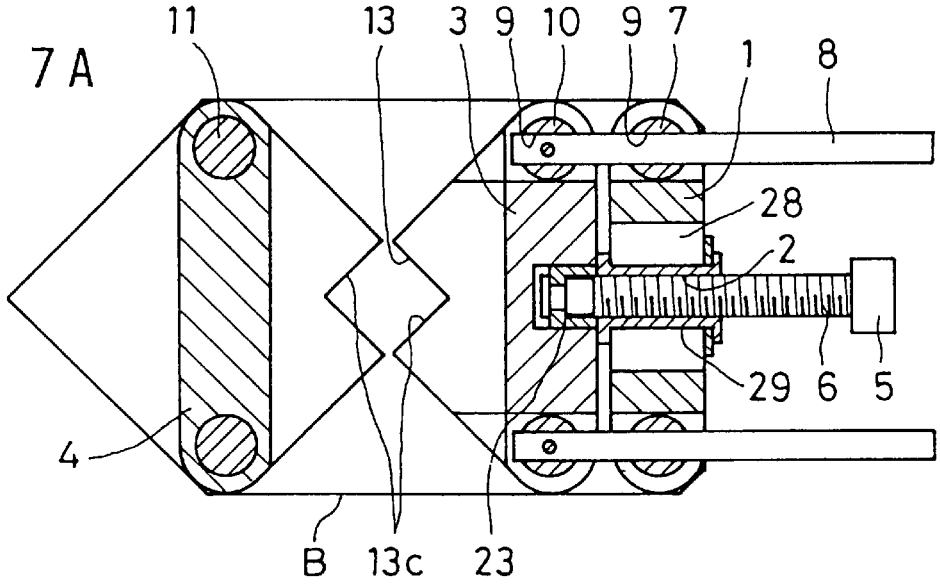
FIGS. 7A and 7B are similar views of a sixth embodiment constructed in accordance with this invention.
Figure 7B:
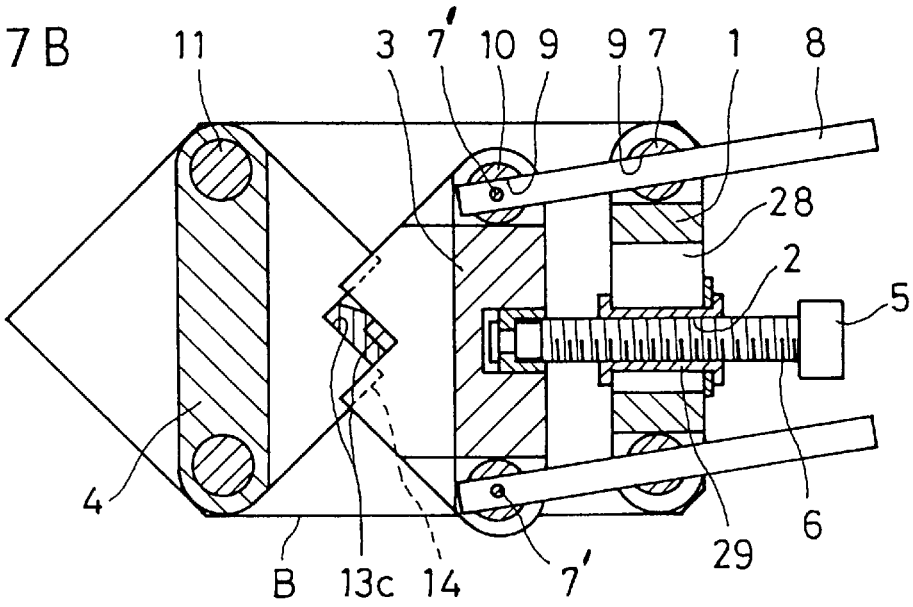

FIGS. 7A–7B show the sixth embodiment, which is basically the same as the fifth embodiment except that the columns 8 extend from the movable yoke 3 to the fixed yoke 1. To grip small articles having irregular shapes, the fixed yoke 1, movable yoke 3 and columns 8 are parallelogrammatically moved so that the columns 8 slide in the holes 9 formed in the pins 7 rotatably provided at both ends of the fixed yoke 1. The article can thus be gripped efficiently and reliably.

Figure 8A:
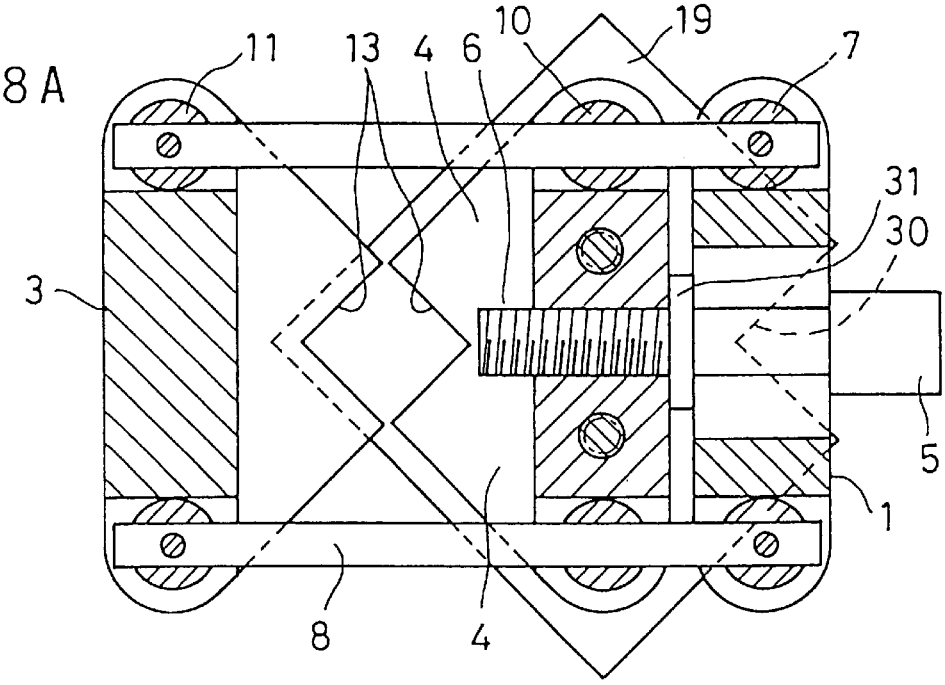
FIGS. 8A and 8B are similar views of a seventh embodiment constructed in accordance with this invention.
Figure 8B:
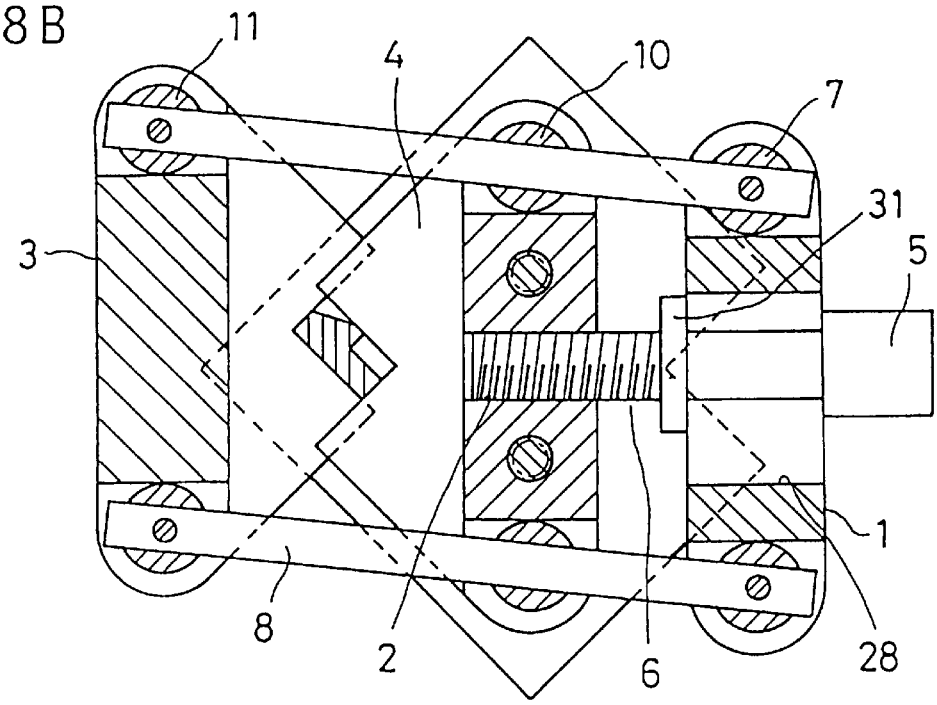

FIGS. 8A–8B show the seventh embodiment, which is basically the same as the third embodiment except that the anvil-side yoke 4 is formed with a threaded hole 2 into which is threaded a threaded shaft 6 received in an elongated hole 28 formed in the fixed yoke 1 so that the threaded shaft 6 and the fixed yoke 1 are slidable relative to each other. The threaded shaft 6 has a flange 31 and a knob 5 that abut both ends of or sides the fixed yoke 1 to prevent axial movement of the yoke 1 relative to the shaft 6.

In this embodiment, the thrust of the threaded shaft 6 is applied directly on the anvil-side yoke 4 to push and pull it. The arrangement of this embodiment is applicable to any of the first to sixth embodiments.

In the above embodiments, the threaded shaft 6 is used to push and pull the movable yoke 3. But instead, the yoke 3 may be pushed and pulled by a cam means, an electromagnetic suction mechanism or a fluid pressure means such as an air cylinder (not shown). By using these means, it is possible to grip articles instantaneously and adapt the device to automated machine tools and industrial robots.

As described above, articles having different shapes can be gripped easily and reliably without working the chucking surfaces or without using V blocks or liners. Further, it is possible to grip a workpiece vertically or with its reference surface aligned with the moving direction of an X-Y table of a machine tool.

What is claimed is:

1. A gripping device for gripping small articles having different shapes, said gripping device comprising:

a fixed yoke;

a movable yoke;

an anvil-side yoke; and an pair of columns extending between said movable yoke and a least one pair of said fixed yoke and said anvil-side yoke, said columns being pivotally coupled thereto by pins that are rotatably provided at both ends of said yokes so as to forma a parallel crank mechanism, said fixed yoke having means for moving said movable yoke relative to said anvil-side yoke, wherein said movable yoke and said anvil-side yoke have portions which are opposed to each other, and each of said opposing portions are being formed with V grooves, and wherein a plurality of parallel cuts are formed in eahc of said opposing portions in order to define a plurality of plate-shaped portions so that said plate-shaped portions of said movable yoke and said anvil-side yoke can mesh with each other.

2. A gripping device as claimed in claim 1 wherein said columns extend between said fixed yoke, said movable yoke and said anvil-side yoke and are pivotally coupled to said respective yokes by pins rotatably provided at both ends of said respective yokes, said movable yoke being slidable relative to said columns.

3. A gripping device as claimed in claim 2 further comprising a block formed by cutting a hexahedral block along its one edge in a V-shape, said block being shaped and sized such that said anvil-side yoke can be rotated by 180 degrees and mounted on said block with the bisector of said V-cut portion of said block in alignment with the bisector of said V-grooved gripping portion of said anvil-side yoke, and that when said V-grooved gripping portion of said anvil-side yoke is at the V-cut portion, said V-grooved gripping portion overhangs said V-cut portion.

4. A gripping device as claimed in claim 2 wherein said means for moving said movable yoke comprises female threads formed on said movable yoke, and male threads formed on a threaded screw so as to be in thread engagement with said female threads.

5. A gripping device as claimed in claim 1 wherein said columns extend from said movable yoke to said anvil-side yoke and are pivotally coupled to said movable yoke and said anvil-side yoke by pins rotatably provided at both ends of said two yokes, said columns being slidable relative to said anvil-side yoke through said pins.

6. A gripping device as claimed in claim 5 wherein said means for moving said movable yoke comprises female threads formed on said movable yoke, and male threads formed on a threaded screw so as to be in thread engagement with said female threads.

7. A gripping device as claimed in claim 1 wherein said columns extend from said fixed yoke to said movable yoke and are pivotally coupled to said two yokes by pins rotatably provided at both ends of said two yokes, said movable yoke being slidable relative to said columns through said pins.

8. A gripping device as claimed in claim 7 wherein said means for moving said movable yoke comprises female threads formed on said movable yoke, and male threads formed on a threaded screw so as to be in thread engagement with said female threads.

9. A gripping device as claimed in claim 1 wherein columns extend from said movable yoke to said fixed yoke and are pivotally coupled to said two yokes by pins rotatably provided at both ends of said two yokes, said columns being slidable relative to said fixed yoke through said pins.

10. A gripping device as claimed in claim 9 wherein said means for moving said movable yoke comprises female threads formed on said movable yoke, and male threads formed on a threaded screws so as to be in thread engagement with said female threads.

11. A gripping device as claimed in claim 1 further comprising a block formed by cutting a hexahedral block along its one edge in a V-shape, said block being shaped and sized such that said anvil-side yoke can be rotated by 180 degrees and mounted on said block with the bisector of said V-cut portion of said block in alignment with the bisector of said V-grooved gripping portion of said anvil-side yoke, and that when said V-grooved gripping portion of said anvil-side yoke is at the V-cut portion, said V-grooved gripping portion overhangs said V-cut portion.

12. A gripping device as claimed in claim 11 wherein said means for moving said movable yoke comprises female threads formed on said movable yoke, and male threads formed on a threaded screw so as to be in thread engagement with said female threads.

13. A gripping device as claimed in claim 1 wherein said means for moving said movable yoke comprises female threads formed on said movable yoke, and male threads formed on a threaded screw so as to be in thread engagement with said female threads.

* * * * *